US008991605B2

(12) United States Patent
Busch

(10) Patent No.: US 8,991,605 B2
(45) Date of Patent: Mar. 31, 2015

(54) PACKAGING UNIT

(75) Inventor: Petra Busch, Windesheim (DE)

(73) Assignee: Boehringer Ingelheim International GmbH, Ingelheim am Rhein (DE)

( * ) Notice: Subject to any disclaimer, the term of this patent is extended or adjusted under 35 U.S.C. 154(b) by 89 days.

(21) Appl. No.: 13/062,724

(22) PCT Filed: Sep. 10, 2009

(86) PCT No.: PCT/EP2009/061760

§ 371 (c)(1),
(2), (4) Date: Apr. 8, 2011

(87) PCT Pub. No.: WO2010/029128

PCT Pub. Date: Mar. 18, 2010

(65) Prior Publication Data

US 2011/0259781 A1 Oct. 27, 2011

(30) Foreign Application Priority Data

Sep. 12, 2008 (EP) ..... 08164235

(51) Int. Cl.
*B65D 83/04* (2006.01)
*B65D 85/42* (2006.01)

(52) U.S. Cl.
CPC ..... *B65D 83/0463* (2013.01); *B65D 2215/02* (2013.01)
USPC ..... 206/531; 206/538; 53/246; 53/454; 53/560

(58) Field of Classification Search
USPC ..... 206/538, 531, 528, 533, 438, 535, 536, 206/1.5, 539; 222/100; 221/154, 191; 53/246, 452–454, 559–561, 471, 475
See application file for complete search history.

(56) References Cited

U.S. PATENT DOCUMENTS 3,199,489 A * 8/1965 Ruoss et al. ..... 116/308
4,165,709 A * 8/1979 Studer ..... 116/308
4,706,815 A 11/1987 Curtis et al.

(Continued)

FOREIGN PATENT DOCUMENTS

DE 202006007552 U1 8/2006
FR 2845668 A1 4/2004

(Continued)

OTHER PUBLICATIONS

International Search Report, Form PCT/ISA/210, for corresponding PCT/EP2009/061760; date of mailing Dec. 23, 2009.

*Primary Examiner* — Luan K Bui
*Assistant Examiner* — Rafael Ortiz
(74) *Attorney, Agent, or Firm* — Michael P. Morris; Mary-Ellen M. Devlin

(57) ABSTRACT

A packaging unit (13) comprises a blister unit (1) with cavities (5) forming receiving chambers (6) accommodating a fill material, particularly a pharmaceutical active substance formulation, and a support unit (7) that supports the blister unit (1) and is releasably attached thereto, of a size corresponding to the blister unit (1). The blister unit (1) has at least one locking opening (3) and the support unit (7) forms a support shell (12) that surrounds the blister unit (1) with a raised edge (8), at least one fastening element (10*a*, 10*b*) of said support shell (12) protruding from the base surface (9) thereof and engaging into the locking opening (3) and holding the blister unit (1) removably clamped in the support shell (12).

12 Claims, 1 Drawing Sheet

(56) References Cited

U.S. PATENT DOCUMENTS

Figures 1, 2, 3:
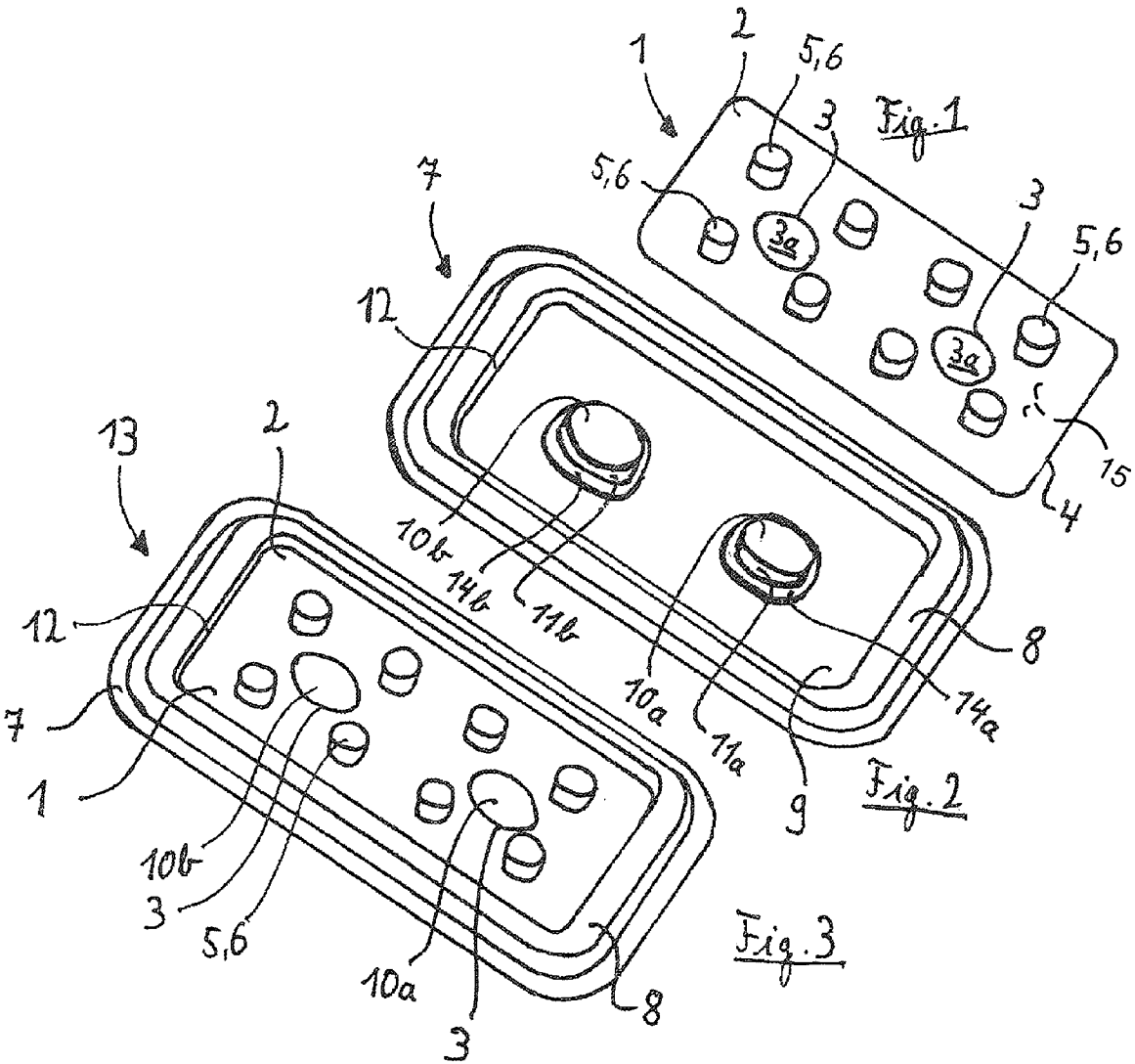

| | | | | |
|---|---|---|---|---|
| 4,915,256 | A * | 4/1990 | Tump | 221/5 |
| 5,019,125 | A * | 5/1991 | Rebne et al. | 206/532 |
| 5,551,597 | A * | 9/1996 | Lambelet et al. | 221/197 |
| 5,878,887 | A | 3/1999 | Parker et al. | |
| 6,024,222 | A | 2/2000 | Assargren et al. | |
| 6,039,208 | A | 3/2000 | Lambelet, Jr. | |
| 6,364,155 | B1 * | 4/2002 | Wolfe | 221/25 |
| 6,502,717 | B1 * | 1/2003 | Wolfe | 221/25 |
| 6,789,677 | B2 | 9/2004 | Maietta | |
| 6,805,258 | B2 * | 10/2004 | Cross | 221/25 |
| 6,824,006 | B2 * | 11/2004 | Lambelet, Jr. | 220/835 |
| 7,243,797 | B2 * | 7/2007 | Donegan | 206/531 |
| 2002/0185404 | A1 | 12/2002 | Donegan | |
| 2003/0102321 | A1 | 6/2003 | Maietta | |
| 2005/0115862 | A1 * | 6/2005 | Maietta | 206/528 |
| 2006/0006091 | A1 | 1/2006 | Maietta | |
| 2006/0049078 | A1 | 3/2006 | Sams | |
| 2006/0118452 | A1 | 6/2006 | Gattefosse et al. | |
| 2007/0023317 | A1 | 2/2007 | Brozell et al. | |
| 2009/0188831 | A1 * | 7/2009 | Blackman | 206/531 |

FOREIGN PATENT DOCUMENTS

| | | | |
|---|---|---|---|
| JP | 1191822 | A | 4/1999 |
| JP | 11313873 | A | 11/1999 |
| JP | 2000513312 | A | 10/2000 |
| JP | 2003335384 | A | 11/2003 |
| JP | 2004239889 | A | 8/2004 |
| JP | 2005510431 | A | 4/2005 |
| JP | 2006109859 | A | 4/2006 |
| JP | 2009002560 | A | 1/2009 |
| JP | 2011091859 | A | 5/2011 |
| WO | 2008061026 | A2 | 5/2008 |

* cited by examiner 1
2
3
3a
4
5,6
7
8
9
10a
10b
11a
11b
12
13
14a
14b
15

PACKAGING UNIT

The invention relates to a packaging unit comprising a blister unit with a fill material, particularly a pharmaceutical active substance formulation, cavities that form receiving chambers and a support unit that supports the blister unit and is removably connected thereto, of a size corresponding to the blister unit. The invention further relates to a method of producing such a packaging unit.

Blister packs are frequently used in the pharmaceutical industry, serving to protect the fill material contained therein, namely the pharmaceutical active substance formulation, from external environmental influences, and to prevent associated adverse effects on the pharmaceutical quality of the active substance formulation in question. Blister packs comprise at least one blister unit which consists of a bottom or carrier film in which are formed cavities that accommodate the fill material, i.e. the particular pharmaceutical active substance formulation, and a top film which covers the top of the respective base or carrier film and in particular closes off the cavities to form sealed receiving chambers. The top film and the bottom or carrier film may be made up of one or more layers of the same or different materials. The top film is attached to the bottom or carrier film, for example, by adhesive bonding, welding or sealing, in particular by a hot glue or sealing wax process. Moreover, the top film and/or the bottom or carrier film are in the form of metal and/or plastics and/or paper film. Typical metal films include for example aluminium films and composite aluminium films. Frequently, a blister unit of this kind consists of a top film of aluminium, which closes off a deep-drawn bottom or carrier film of aluminium. This deep-drawn bottom or carrier film may also enclose an aluminium film to prevent the ingress of water into the cavity where it would be absorbed by the pharmaceutical product. In order to create another diffusion barrier and/or increase the mechanical stability of the blister unit, the aluminium foil of the bottom or carrier film, or else the top film, may optionally be covered on one or both sides with additional plastic and/or paper films. The materials of the top film and the bottom or carrier film may also be present in a plurality of layers. Besides the metal films, typical materials for the manufacture of plastic films include polyvinyl chloride (PVC), cyclo-olefin-copolymer, polychlorotrifluoroethylene (PCFE), polyethylene (PE), polypropylene (PP), polyethylene terephthalate (PET), polycarbonate (PC), polyester (UP), polyacrylate, polyamide (PA) or a multi-layer composite plastic film of one or more of these materials, consisting for example of a combination of polychlorotrifluoroethylene (PCTFE) with polyvinyl chloride (PVC) or polyvinyl chloride (PVC) with polyvinylidene chloride (PVdC).

In some states regulations on childproof packaging of medical or pharmaceutical products are being considered or are already in existence, to make it difficult for children to get hold of medicaments, in particular, which have a toxic effect or constitute a relatively serious risk to health if used inappropriately. This also applies to blister packs.

Considerations of convenience and function also play an increasingly large role in the design of pharmaceutical packaging. For this reason, so-called wallet packs have been developed. These are a combination of a blister pack and a folding carton. A wallet pack of this kind can be flipped open and closed in the manner of a wallet. It consists of one or more blister units in the form of blister cards which are fixedly attached to a secondary packaging, e.g. of folded cardboard. The blister cards may for example be glued, sealed or riveted to the secondary packaging. They may also be attached to the secondary packaging by stickers. A wallet may be subdivided into different numbers of cardboard layers (panels). Information in the form of a booklet may be enclosed in the wallet or attached thereto.

The blister units or blister cards used as part of a packaging unit also have to comply with the relevant statutory requirements. The blister cards used in Europe and the USA differ particularly in terms of their childproof qualities and their senior-friendly qualities.

For the European market, blister cards are used the structure of which is described in the BfArm list that refers to DIN 55559. The blister cards or blister units are produced in a blister machine from an opaque shaped PVC, bottom or carrier film and an aluminium top film. The blister cards can be subdivided into individual sections, each containing one cavity, by means of transverse and longitudinal perforations. To remove the tablet or the respective pharmaceutical active substance formulation, the top film is opened above the cavity. In the case of tablets, this is done in particular by pressing the tablet through the top film of the blister. Because of the combination of materials and the specific cross-perforation, described in the BfArm list, the blister cards are regarded as childproof. In addition, blister cards tested according to DIN 14375 standards and thereby deemed to be childproof may also be used.

For the American market a blister card is preferably used which comprises a transparent shaped PVC, bottom or carrier film and a so-called peel-push top film, which is made up of several layers, e.g. aluminium/PET/paper (from the inside outwards). These blister cards or blister units are also cross-perforated by a longitudinal and transverse perforation and contain unsealed areas at specified points. To remove the tablets or the pharmaceutical active substance formulation, generally a cavity is separated off, to begin with, in order to access a gripper tab (unsealed region) with which the layer of paper/PET is pulled off. A transverse perforation is needed so that the aluminium layer remains intact over the blister cavity when it is torn off. In particular, this perforation may be applied at right angles to the direction of tearing. The tablet or the pharmaceutical active substance formulation is then pushed through the aluminium layer. As a result of the combination of materials and the configuration of the cross-perforation and of the unsealed regions, these blister cards or blister units are deemed to be childproof and/or senior-friendly according to CFR 16 part 1700.

There is therefore a need to provide further fixings and holders for blister cards or blister units with which childproof and senior-friendly packaging units and also, if desired, wallet packs can be produced.

The problem on which the invention is based is therefore to provide a removable attachment of a blister unit to a support unit in a packaging unit of the kind described hereinbefore.

The problem is solved according to the invention in that the blister unit comprises at least one locking opening and the support unit forms a support shell that surrounds the blister unit with a raised edge, at least one fastening element of said support shell protruding from the base surface thereof and engaging into the locking opening and holding the blister unit removably clamped in the support shell.

Similarly, the above-mentioned problem is solved in a process for producing a packaging unit in that a blister unit is produced and after being filled with fill material it is provided with at least one locking opening by stamping out at least one hole and is placed with this opening over a corresponding fastening element of a plastic support unit, to form a clamped connection.

Advantageous and expedient embodiments and further features of the invention will become apparent to the skilled artisan from the disclosure herein.

The invention makes it possible to attach the blister unit to the corresponding support unit easily and without any complications. The packaging unit can be used both for European blisters and for those intended for the American market, while the support unit can be of identical construction for both designs. Moreover, the fixing and arrangement of the blister unit on the support unit provides a relatively childproof packaging unit, as in order to take out the pharmaceutical active substance formulation, particularly in tablet form, from the blister unit, the latter first has to be removed from the support unit which is in the form of a support shell, before the particular pharmaceutical active substance formulation in tablet or capsule form is deliberately removed by pressing through the top or sealing film that closes off the receiving chamber. In order to remove the blister or the blister unit, the closing or fastening mechanism of the fastening element that removably secures the blister unit has to be released. Before the closing or fastening mechanism is thus released the blister unit cannot be removed, particularly by children, because of the raised edge of the support unit surrounding the blister unit. The childproofing is thus provided by the fact that in order to remove the blister unit it is necessary to know that first of all the closing or fastening mechanism has to be released with one hand in order to enable the blister unit to be moved far enough away from the surrounding raised edge of the support unit for the blister unit to be gripped by hand and removed completely from the support unit. This deliberate procedure needed for removing the blister from the support unit is also sufficiently senior-friendly.

In order to form a closing or fastening mechanism that is even more difficult for children to open, according to one feature the blister unit has two spaced-apart, more particularly circular, holes forming locking openings and the support unit has two fastening elements. As a result, in order to undo the clamping connection between the support unit and blister unit, it is necessary to actuate two spaced-apart fastening elements at the same time, so as to undo the clamping fixing and securing of the blister unit to the support unit. This can be done with one hand, so that the other hand can then be used to remove the blister unit. For this purpose, according to a further feature, all the fastening elements are arranged to be reachable and capable of being depressed at the same time with the fingers of one hand. The fastening elements that can be pressed down by the manual application of a pressure force constitute a particularly convenient embodiment of a clamping connection.

To ensure that after the blister unit has been removed it can then be returned to the support unit and secured and held in position by the clamping action of the respective fastening element, the fastening element or elements expediently form(s) a flexible, more particularly elastically movable clamping connection.

To achieve the release of the closing or fastening mechanism by depressing the respective fastening element, the fastening element or elements can preferably be released by the application of pressure from their locking position in which they clamp the blister unit in place.

A particularly expedient embodiment can be obtained using a flange portion formed on the fastening element that passes through the respective locking opening, said flange portion engaging behind the edge of the associated locking opening and gripping it by a clamping action. Therefore, the fastening element or elements each have a flange portion that engages behind the edge of the respective associated locking opening after passing through said opening.

One option for the design and construction of the fastening elements that is tried and tested and easy to produce consists in the fact that the fastening element or elements each has (have) two depressable elastic clamping tongues protruding from the base surface of the support unit. Such a method of fastening, which can be released from its clamping action on the blister unit by the application of a compressive force and depression of the fastening element or elements, is used for example in the securing of CDs or DVDs in known flip-open cases made of plastics. It is therefore advantageous to make the support unit from plastic by an injection moulding method.

As with conventional blister cards, the blister unit comprises a carrier film and a top film, while according to a further feature it is advantageous to produce the blister unit, particularly the carrier film, by a deep-drawing or thermoforming process.

To enable information relating to the pharmaceutical product supplied in the blister unit to be made available as well, the blister unit and the support unit are part of a wallet. All the information on the pharmaceutical active substance formulation can then be provided directly by means of the wallet. In order to produce a particularly stable and slim package, the support unit is attached to a blank that can be folded to form a wallet, particularly a folding cardboard blank. This attachment can be carried out, for example, by mounting the support unit of the packaging unit on a side face of the folding cardboard blank and attaching it thereto by glueing, for example.

Finally, according to one feature of the process, the invention provides that two spaced-apart holes are stamped out of the blister unit and these are each placed over a fastening element protruding from the base surface of the support unit.

Because the support unit is attached to the blister unit in the form of a support shell, it is difficult for children to identify the opening mechanism that has to be actuated in order to remove the blister unit. Adults, by contrast, can undo the attachment or locking of the blister unit in the support shell by depressing the fastening element or the two fastening elements with one finger or two fingers of one hand, for example with the thumb and middle finger, depending on the number of fastening elements, and take out the blister unit with the other hand. In particular, in the embodiment with two fastening elements, the spacing between the two fastening elements is made sufficiently large so that a child's hand cannot reach them both and press them down at the same time. Therefore, a second hand is needed to remove the blister card. However, as soon as a child lets go of a fastening element that has been depressed, by virtue of its flexibility and elasticity this element returns to its locking position in which it clamps and secures the blister unit. For children, this makes it significantly more difficult to remove the blister unit and hence also the pharmaceutical active substance formulation packaged therein, as this would require a knowledge of the opening mechanism described above.

It will be understood that the features mentioned above and those still to be described hereinafter may be used not only in the particular combination given but also in other combinations. The scope of the invention is defined solely by the claims.

The invention is described more fully hereinafter by means of an exemplifying embodiment, referring to the associated drawings, wherein:

FIG. 1 is a schematic perspective view of a blister unit of the packaging unit according to the invention, FIG. 2 is a schematic perspective view of a support unit of the packaging unit, and FIG. 3 is a schematic perspective view of the packaging unit comprising the blister unit and support unit.

The blister unit 1 according to FIG. 1 consists of a rectangular blister card 2 with two locking openings 3 in the form of circular holes 3*a* punched out of the blister card 2, arranged symmetrically and at a spacing from each other on the longitudinal axis of the blister card 2. The perspective view shows the side of the blister unit 1 that consists of a carrier film or bottom film 4. On this side, there are projecting cavities 5 formed by a deep-drawing or thermoforming process which form receiving chambers 6. A pharmaceutical active substance formulation in the form of a tablet or capsule is contained as the fill material in each of the receiving chambers 6. On the side of the blister unit 1 remote from the shaped cavities 5 the receiving chambers are sealed off by means of a carrier film (or top film) 15.

The support unit 7 according to FIG. 2 made from plastics by injection moulding has a surrounding raised edge 8 which encloses a rectangular area corresponding to the rectangular area and hence the size of the blister unit 1. Protruding from the base surface 9, at a spacing from one another and arranged so as to correspond to the locking openings 3 in the blister unit 1, are fastening elements 10*a*, 10*b*. In the fastening or locking position of the blister unit 1 in the support unit 7 shown in FIG. 3, a peripheral portion 11*a*, 11*b* of the fastening elements 10*a*, 10*b* abuts on the inner edge of the associated locking opening 3 to provide a clamping action and clamps the blister unit 1 in the support shell 12 formed by the raised edge. The fastening elements 10*a*, 10*b* are designed to be pressed down by the fingers of one hand and are thus flexible and elastic in construction. Depressing the fastening elements 10*a*, 10*b* causes the respective peripheral portion 11*a*, 11*b* to move away from the associated, correspondingly shaped inner edge of the locking openings 3 and releases the clamping action caused by the frictional forces produced. Thus, the fastening elements 10*a*, 10*b* in conjunction with the locking openings 3 in the form of punched holes form a releasable clamping connection by means of which the blister unit 1 can be releasably attached to the support unit 1 in the support shell 12 that supports the blister unit, and then removed again.

FIG. 3 shows the packaging unit 13 in its locking position made up of the blister unit 1 and support unit 7, in which the fastening elements 10*a*, 10*b* pass through the locking openings 3 in the form of punched holes, so that the blister unit 1 rests on the base surface 12 of the support unit 7 or is held close to the base surface 9. In the locking position, the peripheral portions 11*a*, 11*b* clamp the inner edges of the respective locking opening 3 and hold the blister unit 1 in the locking position shown. The raised edge 8 surrounds the blister unit 1, so that it is not possible to reach the top film side of the blister unit 1 facing the base surface 12 with the finger of one hand. To release the blister unit 1 from the locking and securing position shown in FIG. 3 the user depresses the two fastening elements 10*a*, 10*b* with two fingers of one hand and thus releases the clamping connection of the peripheral portions 11*a*, 11*b* with the inner wall side or inner wall surface of the locking openings 3. The blister unit 1 can then be removed from the support shell 12 using the other hand. Then, by pressing a cavity 5 inwards, the pharmaceutical active substance formulation in the form of a tablet or a capsule can be pushed through the top film and removed. After this, the user can place the blister unit 1 on the support unit 7 again such that the fastening elements 10*a*, 10*b* are aligned with the holes 3*a* and superimposed thereon, so that by the application of pressure using the fingers of one hand the blister unit 1 can be pressed down towards the base surface 12 of the support unit 7 and as a result the fastening elements 10*a*, 10*b* can enter the locking openings 3 again and the peripheral portions 11*a*, 11*b* come to abut on the inner edge wall of the associated locking opening 3 in a clamping action.

The fastening elements 10*a*, 10*b* and the corresponding locking openings 3 are arranged at a spacing from one another such that the fastening elements 10*a*, 10*b* can be simultaneously reached with the fingers of one hand and depressed.

Besides the flexible, more particularly elastically movable clamping connection shown in FIGS. 1 to 3, in the form of circular fastening elements 10*a*, 10*b* protruding from the base surface 9 of the support unit 7, which are designed to be releasable by the application of pressure and depression from their locking position that securely clamps the blister unit 1, and on the release of the pressure to move back automatically into the initial position shown in FIG. 2, it is also possible, in an embodiment not shown here, to design the fastening elements in the form of flexible and especially elastic clamping tongues arranged around the circumference of a circle and protruding from the base surface. The clamping tongues each comprise in particular a flange portion, which after passing through the associated locking opening 3 engages behind the edge of the respective punched hole 3*a*. In the same way, the peripheral portions 11*a*, 11*b* may be constructed as flange portions engaging behind the edge of the associated hole 3*a*.

To produce the packaging unit 13 according to FIG. 3, a blister strip is manufactured in the usual manner by a deep-drawing or thermoforming process and after the cavities have been filled with the desired pharmaceutical active substance formulation the blister strip is provided with a top film and stamped out to produce the card-shaped blister unit 1. At the same time or subsequently, the hole-shaped locking openings 3 are formed in this filled blister unit 1 by stamping out blister card material. The blister unit 1 provided with the locking openings 3 is then placed in the support shell 12, while the fastening elements 10*a*, 10*b* are aligned with and fitted over the hole-shaped locking openings 3 and placed in their mutual locking position by moving the blister unit 1 and support unit 7 towards each other. In this way, the blister unit 1 is fitted onto the support unit 7.

In the embodiment shown, the blister unit 1 has two locking openings 3 and the support unit 7 has two fastening elements 10*a*, 10*b*. However, it is sufficient if the blister unit 1 has at least one locking opening 3 and the support unit 7 has at least one fastening element 10*a* or 10*b*.

For use, the user presses down the two fastening elements 10*a*, 10*b* of the packaging unit 13 according to FIG. 3, so that the clamping connections formed by the peripheral portions 11*a*, 11*b* with the inner edge areas of the locking openings 3 can be released and the blister unit 1 can be removed. After the removal of the pharmaceutical active substance formulation from a cavity 5 or a receiving chamber 6 of the blister unit 1, the locking openings 3 are again moved into a position of alignment on top of the fastening elements 10*a*, 10*b* and the blister unit 1 is pressed onto the fastening elements 10*a*, 10*b*. Because of support surfaces 14*a*, 14*b* formed underneath the peripheral portions 11*a*, 11*b*, the blister unit 1 does not lie on the base surface 9 of the support unit 7, but lies close to it on the support surfaces 14*a*, 14*b*. The circumferential raised edge 8 prevents the top film side of the blister unit 1, in the locking position of the blister unit 1 on the support unit 7 as shown in FIG. 3, from being gripped by hand. By repeatedly removing the blister unit 1 from the support unit 7 and replacing it in the support unit 7, one receiving chamber 6 after another can be emptied and in the mean time the blister unit 1 can be put back in the support shell 12. One skilled in the art will appreciate from the above discussion and the details illustrated in FIG. 3 that the fastening elements (10*a*, 10*b*) non-destructively and releasably engage the corresponding, respective locking openings (3) and hold the blister unit (1) clamped in the support shell (12). Indeed, the respective peripheral portions (11*a*, 11*b*) of the fastening elements (10*a*, 10*b*) are sized and shaped to abut respective inner edges of the locking openings (3) to achieve the aforementioned non-destructive and releasable engagement. In this regard, the fastening elements 10*a*, 10*b* include flexible, elastically movable elements that engage the corresponding openings 3*a*, 3*b*, which are preferably apertures through the carrier film (4). For example, the flexible, elastically movable elements of the fastening elements (10*a*, 10*b*) may include the respective peripheral portions (11*a*, 11*b*), such that such portions bind within the openings 3*a*, 3*b* during engagement, but release when flexion occurs. Thus, when the fastening elements (10*a*, 10*b*) are pressed down at the same time via a user's finger or fingers of one hand, the fastening elements (10*a*, 10*b*) flex and are released from the locking position (i.e., the engagement with the locking openings (3)) by the application of pressure by the user's finger or fingers.

If the fastening elements 10*a*, 10*b* are pressed down without the blister unit 1 being removed, then when the pressure is released the fastening elements 10*a*, 10*b* return to their locking position, clamping the locking device in place. This also contributes to the childproof nature of the packaging unit 13.

The packaging unit 13 may be a part of a so-called wallet if for example the support unit 7 is attached to a foldable blank, particularly a folding cardboard blank, the individual foldable panels or sides of which can be folded onto or over one another. A booklet containing the necessary information regarding the pharmaceutical active substance formulation packaged in the blister unit 1 may also be enclosed in such a wallet.

The invention claimed is:

1. A packaging unit, comprising:

a blister unit (1) with cavities (5) forming receiving chambers (6) accommodating a fill material including a pharmaceutical active substance formulation, and at least one locking opening (3) forming at least one aperture through the blister unit, a support unit (7) that supports the blister unit (1) and is releasably attached thereto, of a size corresponding to the blister unit (1) and forming a support shell (12) that surrounds the blister unit (1) with a raised edge (8), and at least one fastening element (10*a*, 10*b*) protruding from a base surface (9) of the support shell (12), wherein:

the at least one fastening element (10*a*, 10*b*) non-destructively and releasably engages the at least one locking opening (3) and holds the blister unit (1) clamped in the support shell (12), the at least one fastening element (10*a*, 10*b*) forms a flexible, elastically movable mechanism and includes a peripheral portion (11*a*, 11*b*) that is flexible, elastically movable, and sized and shaped to abut an inner edge of the at least one locking opening (3) to non-destructively and releasably engage the blister unit (1) clamped in the support shell (12), the at least one fastening element (10*a*, 10*b*) is arranged to be reachable and capable of being pressed down at the same time via a user's finger or fingers of one hand, and the at least one fastening element (10*a*, 10*b*) flexes and is released from its locking position in engagement with the at least one locking opening (3) of the blister unit (1) by the application of pressure by the user's finger or fingers.

2. The packaging unit according to claim 1, characterised in that the blister unit (1) has two spaced-apart holes (3*a*) forming the locking openings (3) and the support unit (7) has two fastening elements (10*a*, 10*b*).

3. The packaging unit according to claim 1, characterised in that the at least one fastening element has a flange portion that engages behind an edge of the at least one locking opening (3) after passing through said opening.

4. The packaging unit according to claim 1, characterised in that the at least one fastening element has two depressable elastic clamping tongues protruding from the base surface (9) of the support unit (7).

5. The packaging unit according to claim 1, characterised in that the blister unit (1) comprises a carrier film (4) within which the cavities (5) are disposed and a top film (15) on the carrier (4) overlying the cavities (5).

6. The packaging unit according to claim 5, characterised in that the blister unit (1) is held in the support shell (12) with the top film (15) facing the base surface (9) of the support unit (7).

7. The packaging unit according to claim 1, characterised in that the carrier film (4) is produced by a deep-drawing or thermoforming process.

8. The packaging unit according to claim 1, characterised in that the support unit (7) is produced from plastics by an injection moulding process.

9. The packaging unit according to claim 1, characterised in that the blister unit (1) and the support unit (7) are components of a wallet.

10. A method of producing a packaging unit, comprising:

filling a blister card unit (1) with fill material, providing the blister card unit (1) with at least one locking opening by stamping out at least one locking opening (3*a*), forming at least one aperture through the blister card unit (1), and placing the locking opening (3) over a corresponding fastening element (10*a*, 10*b*) of a shell-shaped support unit (7) made of plastics, which forms a clamping holder, such that the packaging unit includes:

the blister unit (1) with cavities (5) forming receiving chambers (6) accommodating the fill material including a pharmaceutical active substance formulation, the support unit (7) that supports the blister unit (1) and is releasably attached thereto, of a size corresponding to the blister unit (1) and forming a support shell (12) that surrounds the blister unit (1) with a raised edge (8), and the at least one fastening element (10*a*, 10*b*) protruding from a base surface (9) of the support shell (12), wherein:

the at least one fastening element (10*a*, 10*b*) non-destructively and releasably engages the at least one locking opening (3) and hold the blister unit (1) removably clamped in the support shell (12), the at least one fastening element (10*a*, 10*b*) forms a flexible, elastically movable mechanism and includes a peripheral portion (11*a*, 11*b*) that is flexible, elastically movable, and sized and shaped to abut an inner edge of the at least one locking opening (3) to non-destructively and releasably engage the blister unit (1) clamped in the support shell (12), the at least one fastening element (10*a*, 10*b*) is arranged to be reachable and capable of being pressed down at the same time via a user's finger or fingers of one hand, and the at least one fastening element (10*a*, 10*b*) flexes and is released from its locking position in engagement with the at least one locking opening (3) of the blister unit (1) by the application of pressure by the user's finger or fingers.

11. The method according to claim 10, characterised in that two spaced-apart holes (3*a*) are punched in the blister unit (1) and these are each placed over the fastening element (10*a*, 10*b*) protruding from the base surface (9) of the support unit (7).

12. The packaging unit according to claim 1, characterised in that the fixing and arrangement of the blister unit (1) on the support unit (7) provides a childproof packaging unit in that, in order to take out the pharmaceutical active substance formulation from the blister unit (1), the blister unit (1) must first be removed from the support unit (7).

* * * * *